US007463203B2

(12) United States Patent
Takeguchi et al.

(10) Patent No.: US 7,463,203 B2
(45) Date of Patent: Dec. 9, 2008

(54) ELECTRONIC DEVICE

(75) Inventors: Koichiro Takeguchi, Hachioji (JP); Shigeo Hayashi, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/844,972

(22) Filed: Aug. 24, 2007

(65) Prior Publication Data

US 2008/0129609 A1 Jun. 5, 2008

(30) Foreign Application Priority Data

Nov. 30, 2006 (JP) ..... 2006-324478

(51) Int. Cl.
*H01Q 1/24* (2006.01)

(52) U.S. Cl. ..... 343/702; 343/906

(58) Field of Classification Search ..... 343/702, 343/700 MS, 904, 905, 906
See application file for complete search history.

(56) References Cited

U.S. PATENT DOCUMENTS 6,509,877 B2 1/2003 Masaki
6,574,115 B2 * 6/2003 Asano et al. ..... 361/775
6,630,908 B2 * 10/2003 Gushiken ..... 343/702
2003/0169205 A1 * 9/2003 Gioia et al. ..... 343/702

FOREIGN PATENT DOCUMENTS

JP 2003-244017 8/2003
JP 2006-174219 6/2006

* cited by examiner

*Primary Examiner*—HoangAnh T Le
(74) *Attorney, Agent, or Firm*—Blakely, Sokoloff, Taylor & Zafman LLP

(57) ABSTRACT

According to one embodiment, an electronic device is provided with the following an antenna, a first radio module configured to perform wireless communications by use of the antenna, a second radio module configured to perform wireless communications by use of the antenna, a first printed circuit board with reference to which the second radio module is attachable or detachable, a first cable which connects the antenna and the second radio module together, a second cable which connects the second radio module and the first radio module together, and a connection mechanism which connects the first and second cables together in a state where the second radio module is is detached from the first printed circuit board.

6 Claims, 10 Drawing Sheets

ELECTRONIC DEVICE

CROSS-REFERENCE TO RELATED APPLICATIONS

This application is based upon and claims the benefit of priority from Japanese Patent Application No. 2006-324478, filed Nov. 30, 2006, the entire contents of which are incorporated herein by reference.

BACKGROUND

1. Field

One embodiment of the invention relates to an electronic device comprising a radio communication unit.

2. Description of the Related Art

Jpn. Pat. Appln. KOKAI Publication No. 2003-244017 discloses the following radio communication unit. The radio communication unit includes an antenna, a radio analog section, a modulating/demodulating section, and a bus control section. A switch, a LAN communication control section and an AV communication control section are provided between the modulating/demodulating section and the bus control section. The switch enables switching between the condition where the LAN communication control section is used and the condition where the AV communication control section is used.

When the radio communication unit performs communications by use of a radio LAN communication system, the switch is operated to turn on the LAN communication control section and turn off the AV communication control section. On the other hand, when the radio communication unit performs communications by use of a radio AV transmission communication system, the switch is operated to turn off the LAN communication control section and turn on the AV communication control section. In this manner, the antenna, the radio analog section, the modulating/demodulating section and the bus control section are used in common to the two modes.

To perform wireless communications using two radio communication modules of different communication systems, it is thought to provide an electronic device with an antenna that can be used for the two different communication systems. For example, the electronic device comprises an antenna, a Bluetooth module, an antenna cable provided between the antenna and the Bluetooth module, and a UWB module provided at a midpoint of the antenna cable.

However, electronic devices have different configurations, depending upon the countries and regions where they are sold. For example, electronic devices sold in one country are provided with a UWB module, whereas electronic devices sold in another are not. In electronic devices provided with a UWB module, an antenna and a UWB module have to be connected by use of a short first cable, and the UWB module and a Bluetooth module have to be connected by use of a short second cable. In electronic devices provided with no UWB module, an antenna and a Bluetooth module have to be connected directly to each other by use of a long cable. Under the circumstances, two types of cables different in length have to be prepared, resulting in an increase in the parts of the electronic devices.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic device is provided with the following an antenna; a first radio module configured to perform wireless communications by use of the antenna; a second radio module configured to perform wireless communications by use of the antenna; a first printed circuit board with reference to which the second radio module is attachable or detachable; a first cable which connects the antenna and the second radio module together; a second cable which connects the second radio module and the first radio module together; and a connection mechanism which connects the first and second cables together in a state where the second radio module is detached from the first printed circuit board.

Figure 1:
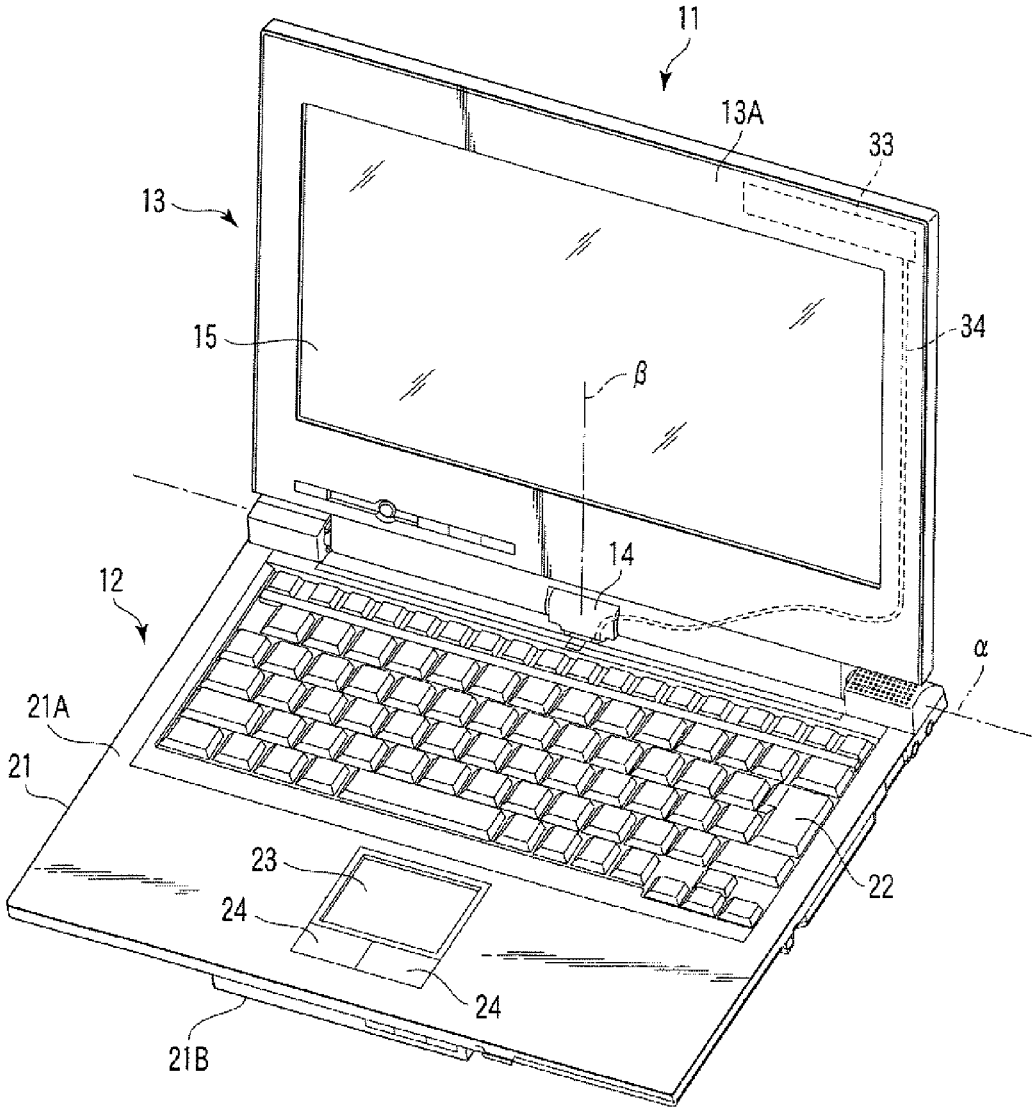
FIG. 1 is an exemplary perspective view of a portable computer, which is an example of an electronic device according to the first embodiment.

An electronic device according to an embodiment will now be described with reference to FIGS. 1-6. As shown in FIG. 1, the portable computer 11, which is an example of an electronic device, comprises a main body unit 12, a display unit 13, and a hinge mechanism 14 provided between the main body unit 12 and the display unit 13. The hinge mechanism 14 supports the display unit 13. The hinge mechanism 14 permits the display unit 13 to be rotated relative to the main body unit 12, with axis $\alpha$ as a center. The hinge mechanism 14 also permits the display unit 13 to be rotated relative to the main body unit 12, with axis $\beta$ as a center.

The display unit 13 is provided with a liquid crystal display 15. The liquid crystal display 15 is an example of a display which is connected to a first printed circuit board 17 of the main body unit 12 and which displays information. The display of the display unit 13 is not limited the liquid crystal display 15 described above; it may be a plasma display, an organic electroluminescence display, a surface-conductance electron emission element display, or the like.

Figure 2:
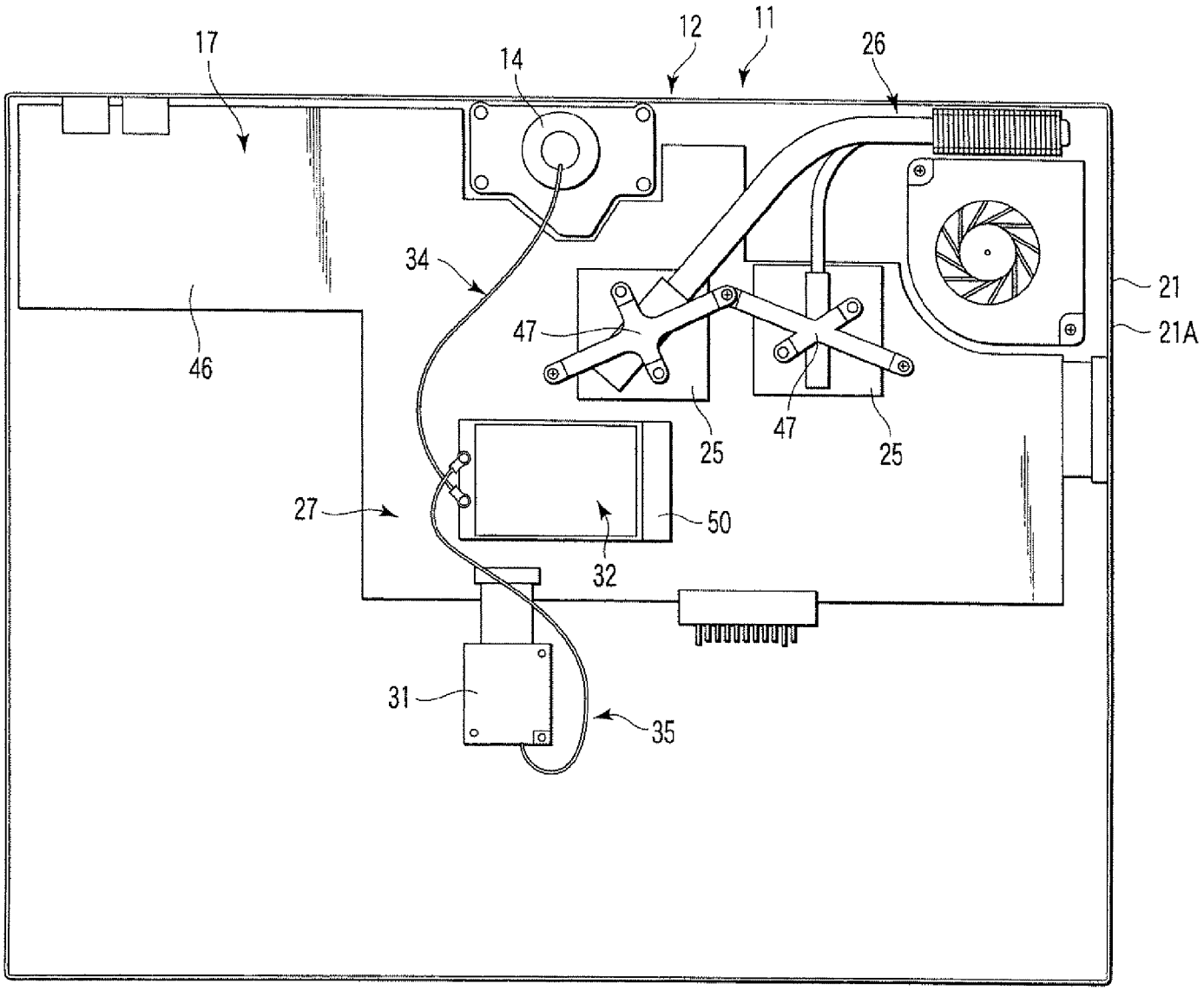
FIG. 2 is an exemplary bottom view showing a radio unit contained in the casing of the portable computer shown in FIG. 1. Illustration of the second case is omitted in FIG. 2.

The main body unit 12 includes a housing 21, a keyboard 22, a touch pad 23 and buttons 24. The housing 21 is made up of a first case 21A and a second case 21B. As shown in FIG. 2, the housing 21 contains a cooling device 26 for cooling circuit components 25, and a radio unit 27 for performing wireless communications with an external electronic device.

As shown in FIG. 2, the radio unit 27 includes the first printed circuit board 17, a first radio module 31, a second radio module 32, an antenna 33, a first cable 34 and a second cable 35. The first radio module 31 is a Bluetooth module. The first radio module 31 enables the portable computer 11 to perform wireless communications by means of an antenna 33 based on the Bluetooth standard.

Figure 3:
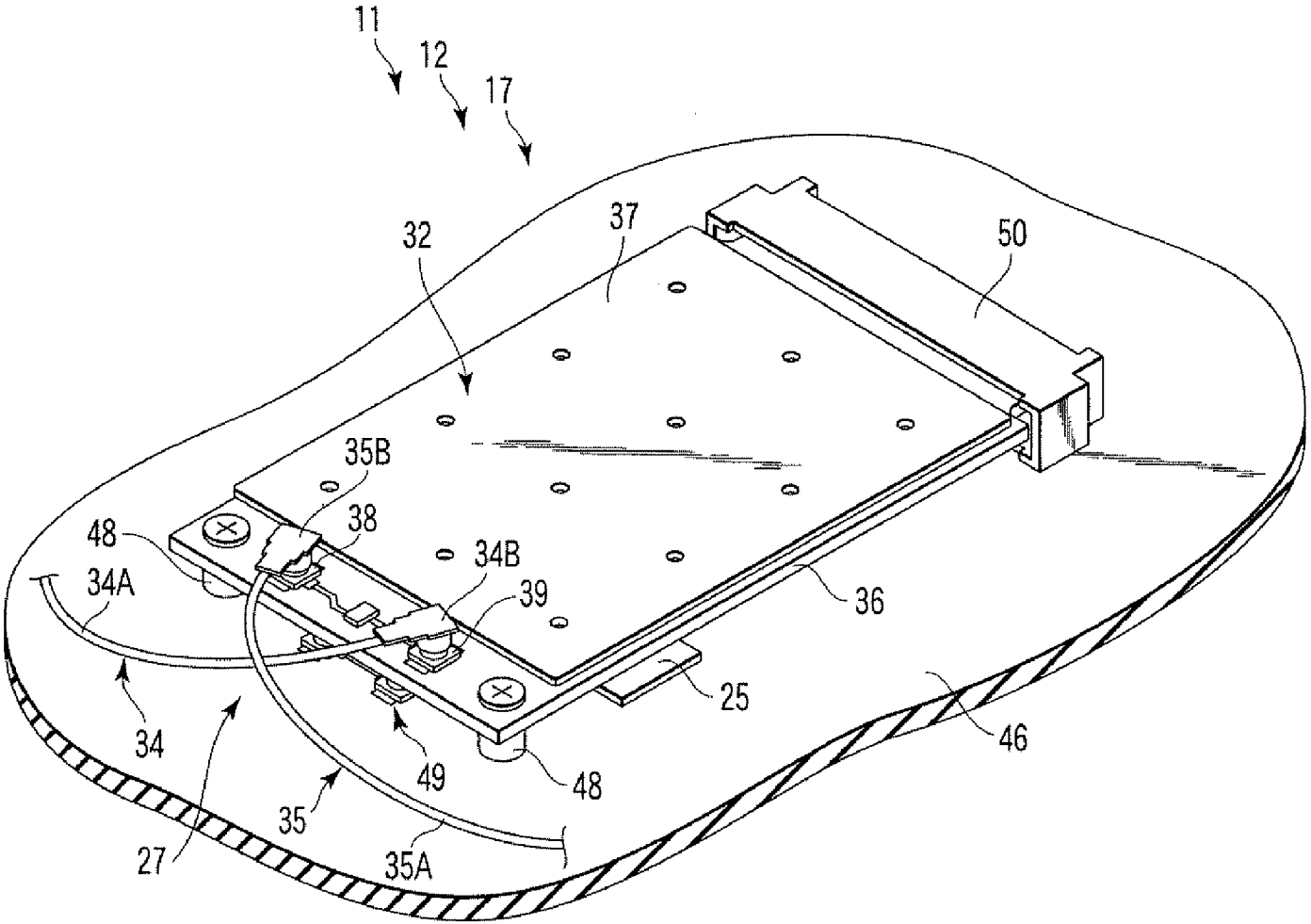
FIG. 3 is an exemplary perspective view showing a second radio module of the radio unit shown in FIG. 2.

The second radio module 32 is a so-called UWB module. The second radio module 32 permits the portable computer 11 to perform high-speed wireless communications by means of the antenna 33 based on the UWB standard. As shown in FIG. 3, the second radio module 32 includes a substrate 36, a module main body 37 mounted on the substrate 36, an input terminal 38 to which signals from the first radio module 31 are supplied, and an output terminal 39 from which signals are supplied to the antenna 33. The input terminal 38 and the output terminal 39 are female connectors generally referred to as "Co-Axial". Each of the input and output terminals 38 and 39 is designed to have a resistance of 50Ω. The second radio module 32 is fixed to studs 48 of the first printed circuit board 17 by means of screws. The second radio module 32 can be fixed to the first printed circuit board 17 or removed from it.

As shown in FIG. 1, the antenna 33 is located inside of the cover 13A of the display unit 13. The antenna 33 is compatible with both the Bluetooth and UWB standards, and can perform wireless communications based on either of the two standards.

As shown in FIGS. 1-3, the first cable 34 is an antenna cable and connects the antenna 33 and the second radio module 32 together. The first cable 34 includes a cable main body 34A, and a first connector 34B at which the cable main body 34A is connected to the second radio module 32. The first connector 34B is a male connector.

As shown in FIGS. 2 and 3, the second cable 35 is an antenna cable and connects the first radio module 31 and the second radio module 32 together. The second cable 35 includes a cable main body 35A, and a second connector 35B at which the cable main body 35A is connected to the second radio module 32. The second cable 35 has a similar structure to that of the first cable 34 but is shorter than the first cable 34. The second connector 35B is a male connector.

Figure 4:
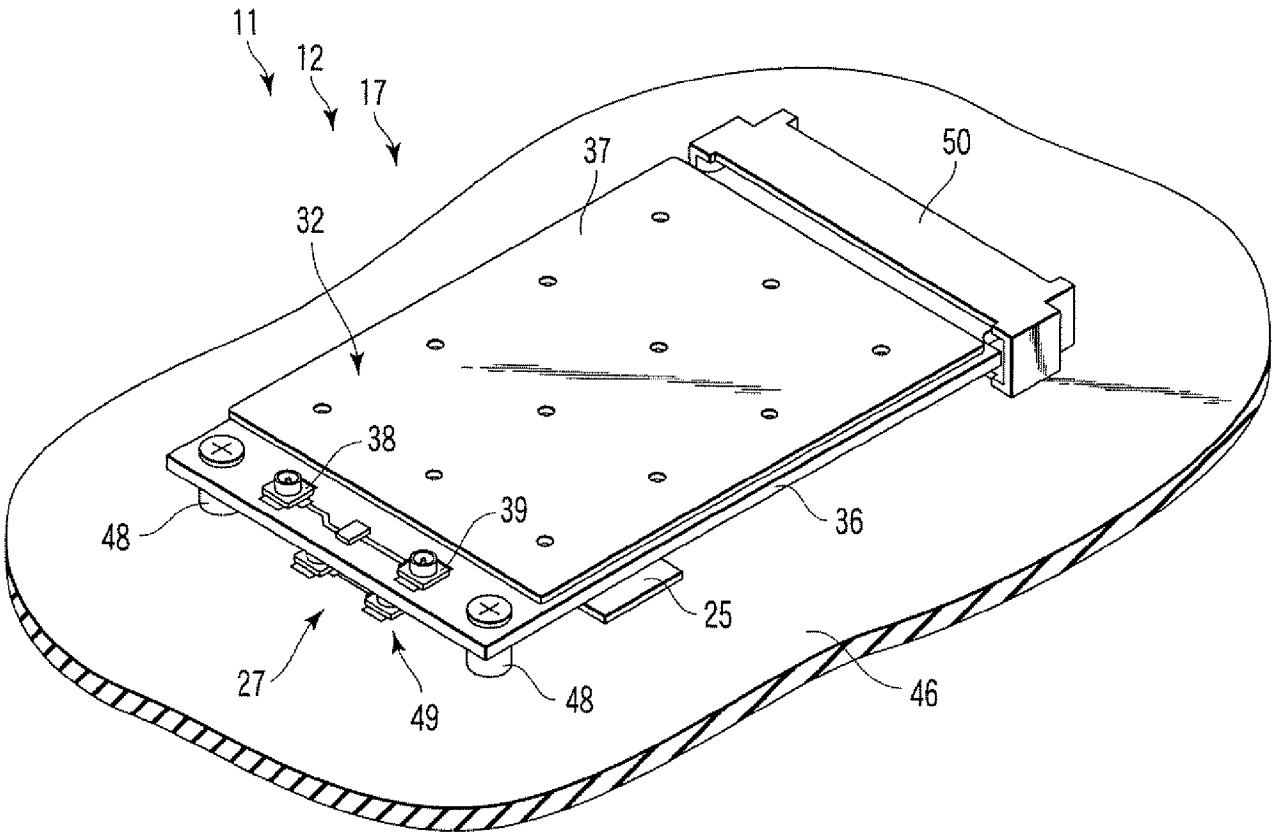
FIG. 4 is an exemplary perspective view showing the second module depicted in FIG. 3 in the state where a first cable and a second cable are removed.
Figure 5:
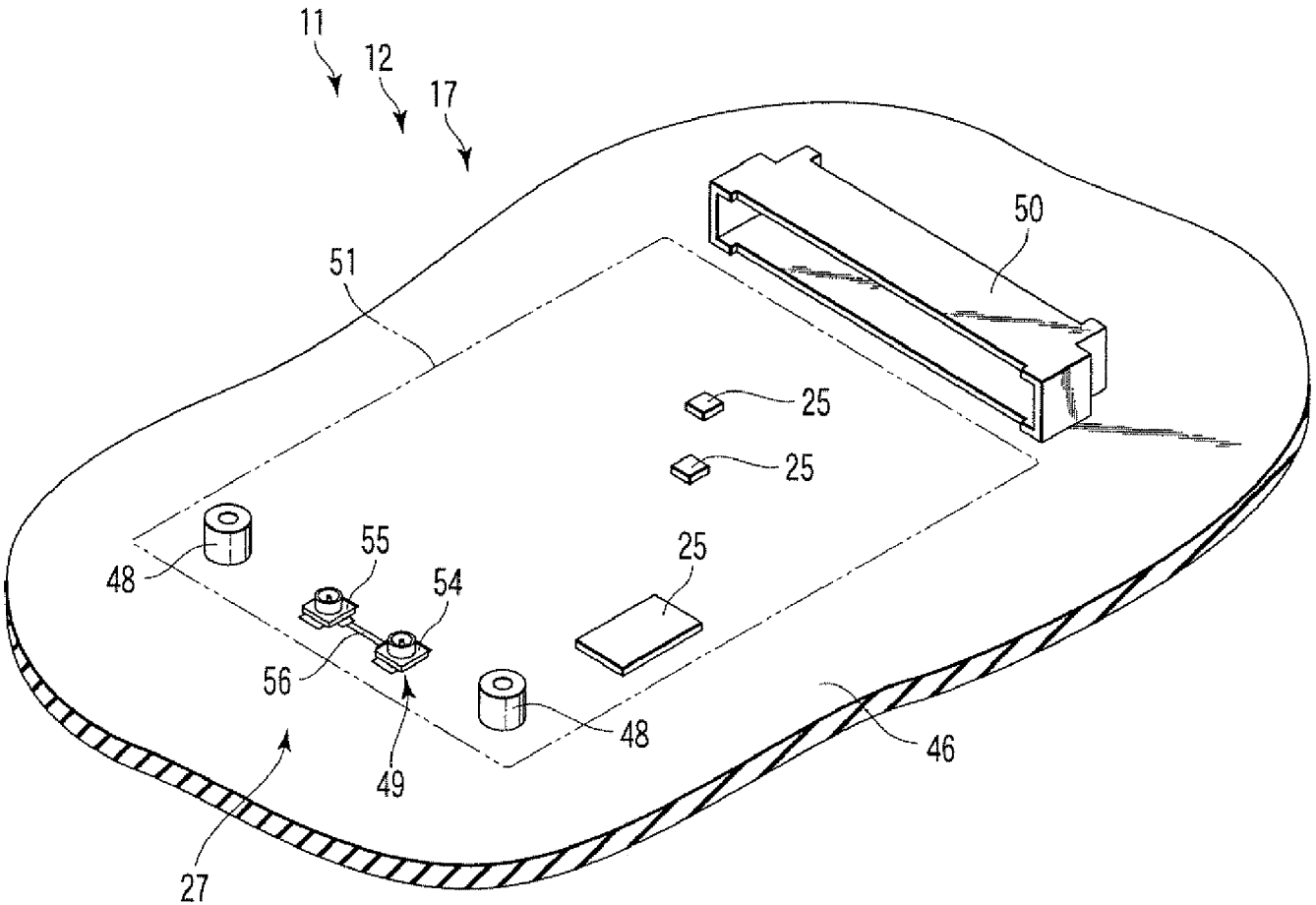
FIG. 5 is an exemplary perspective view showing the radio unit in the state where the second radio module depicted in FIG. 3 is removed.

As shown in FIGS. 2-5, the first printed circuit board 17 includes the following: a printed wiring board 46 made by stacking copper wiring layers; a plurality of circuit components 25 mounted on the printed wiring board 46; a fixing mechanism 47 which fixes the cooling device 26 to the printed wiring board 46; studs 48 provided on the printed wiring board 46; a connection mechanism 49 used for connecting the first cable 34 and the second cable 35 to each other; and a rectangular connector 50 used for connection to the second radio module 32. As shown in FIG. 5, the first printed circuit board 17 has an attachment area 51 to which the second radio module 32 is attached. The second radio module 32 can be attached to the first printed circuit board 17 or removed from it.

As shown in FIG. 5, the connection mechanism 49 is provided on the first printed circuit board 17. More specifically, the connection mechanism 49 is located within the above-mentioned attachment area 51 on the first printed circuit board 17. The connection mechanism 49 includes a first relay connector 54 and a second relay connector 55, both of which are mounted on the first printed circuit board 17, and a wiring line 56 that connects the first and second relay connectors 54 and 55 together. The connection mechanism 49 can connect the first cable 34 and second cable 35 together in the state where the second radio module 32 is removed from the first printed circuit board 17.

The first relay connector 54 and the second relay connector 55 are female connectors generally referred to as "Co-Axial". Each of the first and second relay connectors 54 and 55 is designed to have a resistance of 50Ω.

A description will now be given with reference to FIG. 3 as to how electrical connections are made in the radio unit 27 where the second radio module 32 is provided for the portable computer 11. The first radio module 31, which is a Bluetooth module, is electrically connected to the antenna 33 by means of the first cable 34, second cable 35 and second radio module 32. On the other hand, the second radio module 32, which is a UWB module, is electrically connected to the antenna 33 by means of the first cable 34. With this structure, the portable computer 11 can perform wireless communications in both the Bluetooth mode and the UWB mode.

Figure 6:
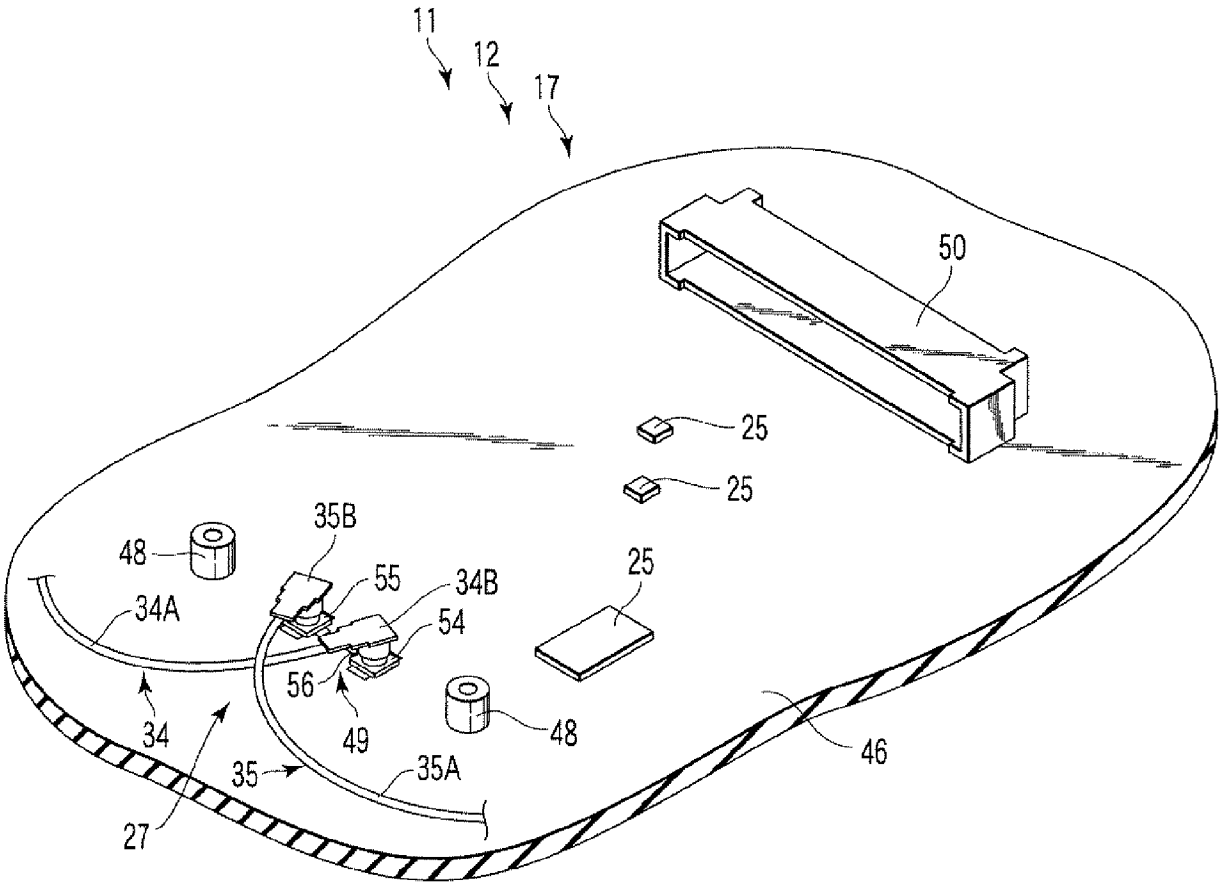
FIG. 6 is an exemplary perspective view showing how the first and second cables are connected to the radio unit shown in FIG. 5.

A description will now be given with reference to FIG. 6 as to how electrical connections are made in the radio unit 27 where the second radio module 32 is not provided for the portable computer 11. Where the second radio module 32 is not provided for the first printed circuit board 17, the first cable 34 is connected to the first relay connector 54 of the connection mechanism 49 of the first printed circuit board 17. On the other hand, the second cable 35 is connected to the second relay connector 55 of the connection mechanism 49 of the first printed circuit board 17. With this structure, the first cable 34 and the second cable 35 are electrically connected to each other through the connection mechanism 49. In this state, first radio module 31 is electrically connected to the antenna 33.

Let us assume that the user mounts the second radio module 32 on the first printed circuit board 17 after purchasing the portable computer 11. In this case, the first cable 34 and the second cable 35 are removed from the connection mechanism 49 in the state shown in FIG. 6. As a result, the state shown in FIG. 5 is created. Furthermore, as shown in FIG. 4, the user attaches the second radio module 32 to the studs 48 of the first printed circuit board 17. As shown in FIG. 3, the user connects the first cable 34 to the output terminal 39 of the second radio module 32. In addition, the user connects the second cable 35 to the input terminal 38 of the second radio module 32. In this manner, the first radio module 31 and the second radio module 32 are electrically connected to the antenna 33, thereby completing the attaching operation of the second radio module 32.

The electronic device according to the first embodiment has been described. According to the first embodiment, the portable computer 11, which is an example of the electronic device, comprises the following: the first printed circuit board 17 with reference to which the second radio module 32 is attachable or detachable; the first cable 34 that connects the antenna 33 and the second radio module 32 to each other; the second cable 35 that connects the second radio module 32 and the first radio module 31 to each other; and the connection mechanism 49 that connects the first cable 34 and second cable 35 to each other in the state where the second radio module 32 is detached from the first printed circuit board 17. With this structure, the connection mechanism 49 maintains connection between the first radio module 31 and the antenna 33 in the state where the second radio module 32 is removed. As a result, the first radio module 31 and antenna 33 are prevented from being disconnected in the state where the second radio module 32 is removed, and the electrical connection between the first radio module 31 and the antenna 33 is thus maintained. The first cable 34 and the second cable 35, by which the first radio module 31 and antenna 33 are connected, can be of the same type irrespective of whether or not the second radio module 32 is mounted.

It should be noted that the connection mechanism 49 is mounted on the first printed circuit board 17. With this structure, the connection mechanism 49 need not be provided independently of the first printed circuit board 17, and the number of structural components required can be reduced, accordingly.

The first printed circuit board 17 is provided with the attachment area 51, and the connection mechanism 49 is provided on the attachment area 51. With this structure, the connection mechanism 49 is arranged at substantially the same position as the input and output terminals 38 of the second radio module 32. That is, even where the connection mechanism 49 is provided, it may be located away from the attachment area 51, and the first or second cable 34 or 35 does not have to be extended to the connection mechanism 49. As long as the connection mechanism 49 is located within the attachment area 51, as in the present embodiment, it is possible to prevent the situation where either the first cable 34 or the second cable 35 cannot be extended to the connection mechanism 49. Hence, the portable computer 11 that is provided with the second radio module 32 and the portable computer 11 that is not provided with the second radio module 32 can use cables of the same length as the first and second cables 34 and 35. In other words, the first and second cables 34 and 35 can be of the same length irrespective of the type of portable computer 11. Furthermore, where the connection mechanism 49 is formed in the attachment area 51 of the first printed circuit board 17, it is possible to make good use of the lower area of the second radio module 32.

It should be noted that the connection mechanism 49 is provided with a pair of relay connectors 54 and 55 and a wiring line 56 that connects the relay connectors 54 and 55. With this structure, the connection mechanism 49 can be as simple as possible. Furthermore, the connection mechanism 49 can be manufactured at low cost because it can be made by simply connecting existing relay connectors by means of a copper wire.

In the first embodiment, the first radio module 31 is a Bluetooth module, and the second radio module 32 is a UWB module. By use of these, the portable computer 11 can perform both wireless communications based on the Bluetooth standard and wireless communications based on the UWB standard.

An electronic device according to the second embodiment will now be described with reference to FIGS. 7-10.

A portable computer 61, which is an example of the electronic device according to the second embodiment, is different from the portable computer 11 of the first embodiment in terms of the position where the connection mechanism 49 is provided. In the other points, the former is similar to the latter. In the descriptions below, reference will be made mainly to the differences. In other words, components that are similar to those of the first embodiment will be denoted by the same reference numerals as used in connection with the first embodiment, and a detailed description of such components will be omitted.

Figure 7:
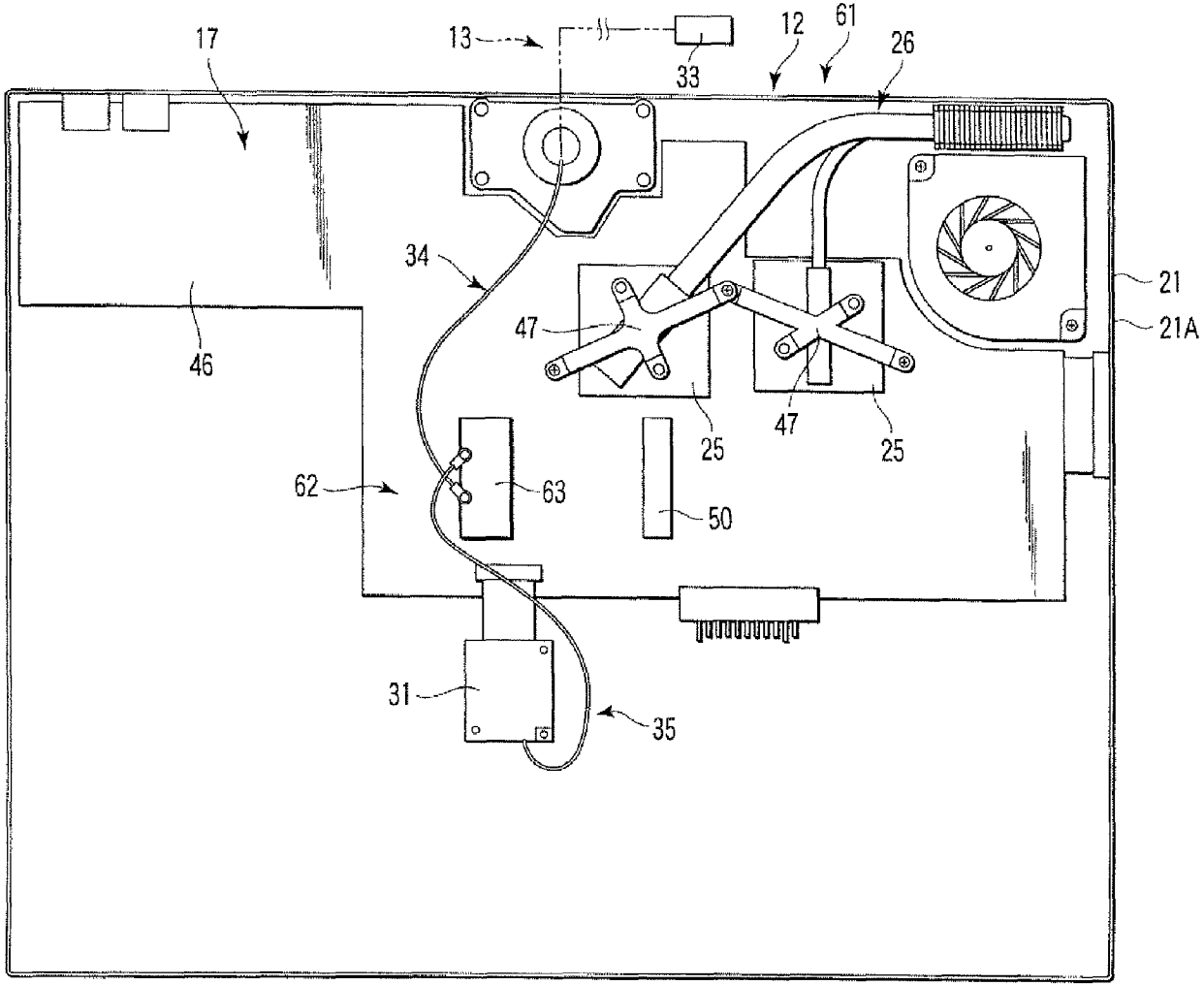
FIG. 7 is an exemplary bottom view showing a portable computer, which is an example of an electronic device according to the second embodiment of the present invention. Illustration of the second case is omitted in FIG. 7.
Figure 8:
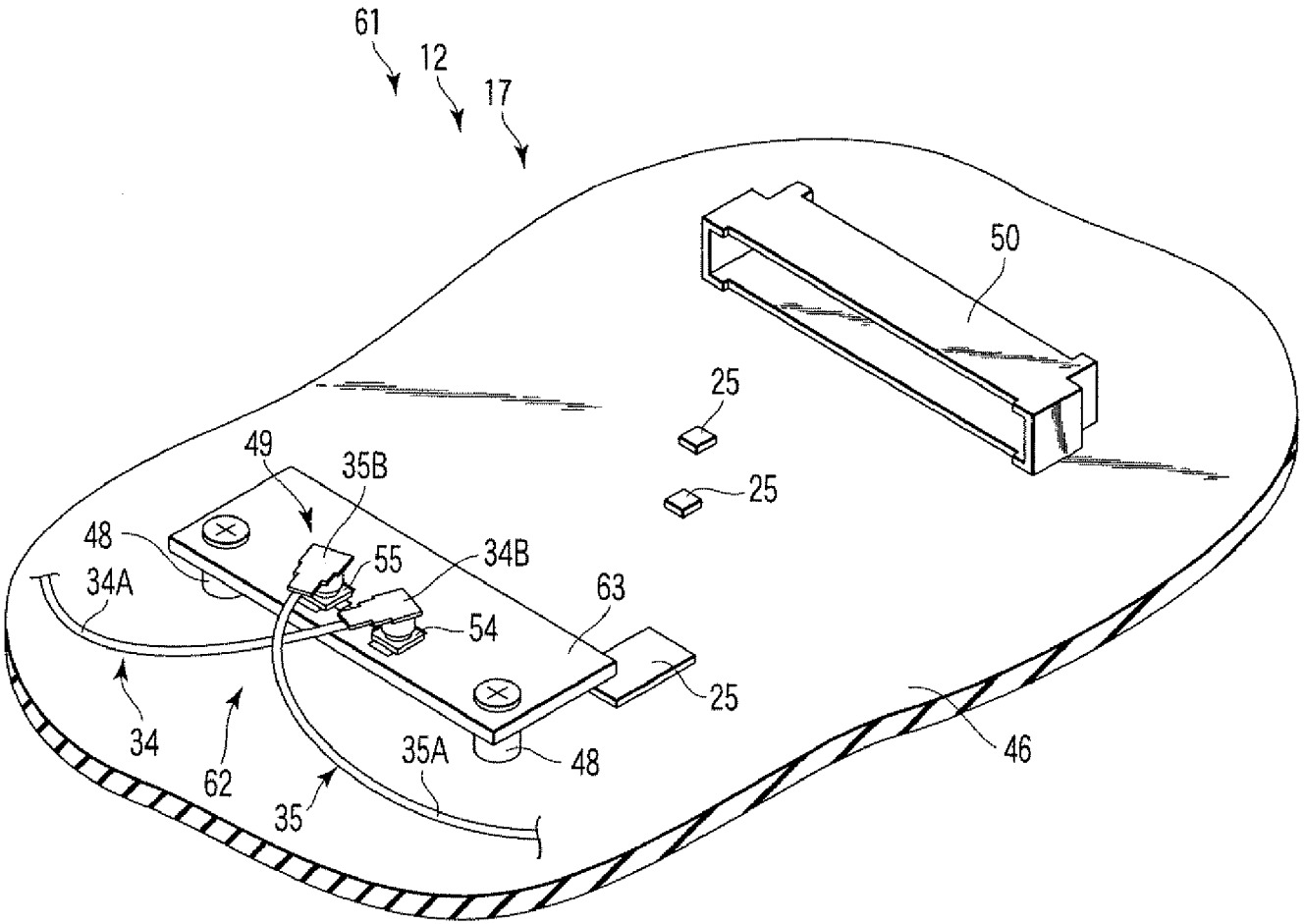
FIG. 8 is an exemplary perspective view showing a radio module of the portable computer which is the example of the electronic device of the second embodiment.

As shown in FIG. 7, the portable computer 61 comprises a main body unit 12, a display unit 13, and a hinge mechanism 14 provided between the main body unit 12 and the display unit 13. The main body unit 12 includes a housing 21, a keyboard 22, a touch pad 23 and buttons 24. The housing 21 contains a cooling device 26 for cooling circuit components 25, and a radio unit 62 for performing wireless communications with an external electronic device. The housing 21 is made up of a first case 21A and a second case 21B. The radio unit 62 is provided with a first printed circuit board 17, a second printed circuit board 63, a first radio module 31, a second radio module 32, an antenna 33, a first cable 34, and a second cable 35. In FIG. 8, the second printed circuit board 63 is attached to the first printed circuit board 17, in place of the second radio module 32 shown in FIG. 10. In other words, the second printed circuit board 63 is attached to the first printed circuit board 17, replacing the second radio module 32.

Figure 9:
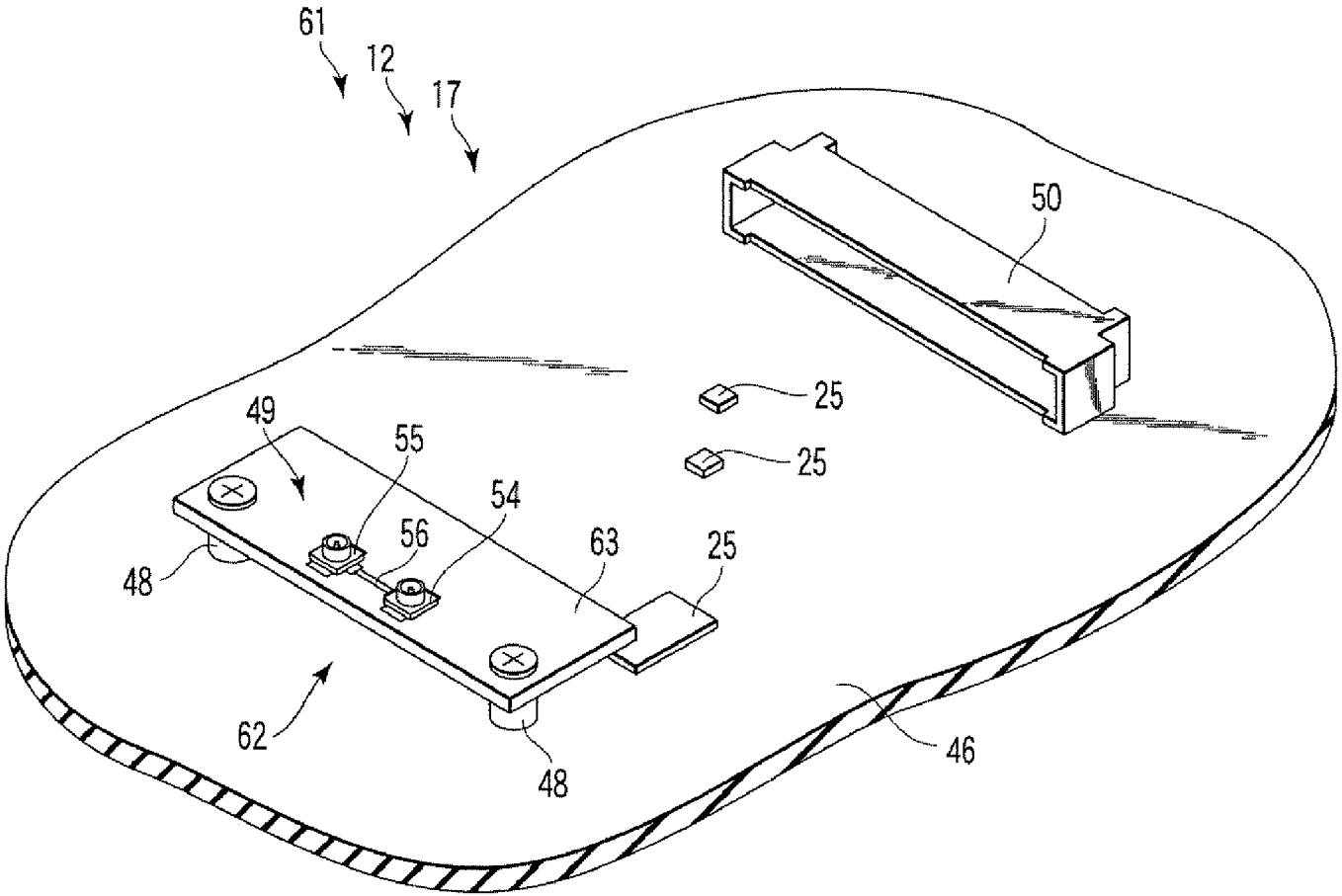
FIG. 9 is an exemplary perspective view showing the radio unit depicted in FIG. 8 in the state where a first cable and a second cable are removed.

As shown in FIGS. 8 and 9, the second printed circuit board 63 is a small rectangular board. The second printed circuit board 63 is fixed to studs 48 of the first printed circuit board 17 by means of screws.

As shown in FIG. 9, the connection mechanism 49 is provided on the second printed board 63. The connection mechanism 49 includes a first relay connector 54 and a second relay connector 55, which are mounted on the second printed circuit board 63, and a wiring line 56 which connects the first and second relay connectors 54 and 55 together. The first and second relay connectors 54 and 55 are female connectors generally referred to as "Co-Axial".

Figure 10:
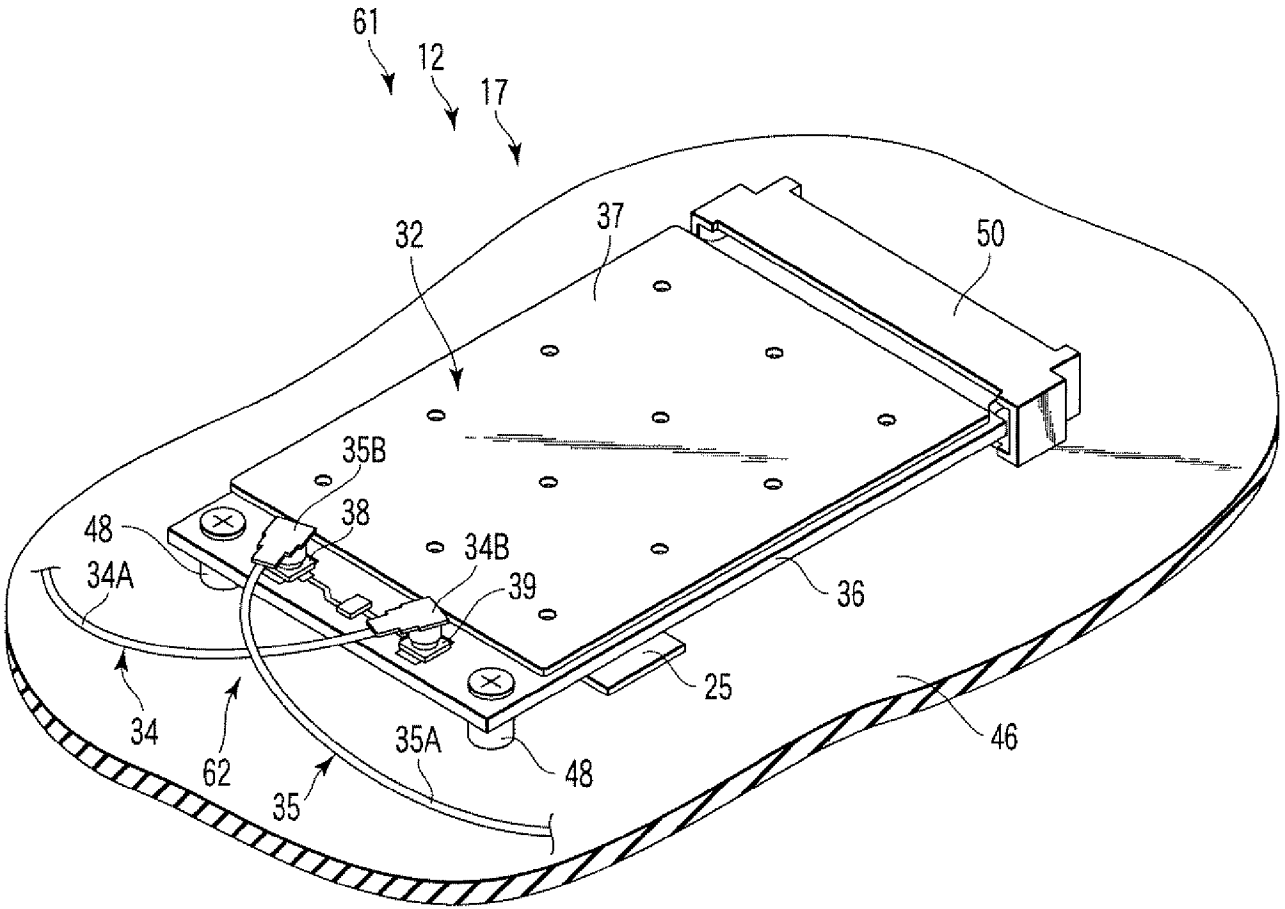
FIG. 10 is an exemplary perspective view showing how a second radio module is mounted on the radio unit depicted in FIG. 9.

A description will now be given with reference to FIGS. 8-10 as to how electrical connections are made in the radio unit 62 of the second embodiment. In the second embodiment, the second radio module 32 is not mounted on the first printed circuit board 17 beforehand, as shown in FIG. 8, so that the first cable 34 and the second cable 35 are connected through the connection mechanism 49. To be more specific, the first cable 34 is connected to the first relay connector 54 of the connection mechanism 49 of the second printed circuit board 63. On the other hand, the second cable 35 is connected to the second relay connector 55 of the connection mechanism 49 of the second printed circuit board 63.

Let us assume that the user mounts the second radio module 32 in place, after purchasing the portable computer 61. In this case, the first cable 34 and the second cable 35 are removed from the connection mechanism 49 in the state shown in FIG. 9. Furthermore, as shown in FIG. 10, the user detaches the second printed circuit board 63 from the studs 48 and fixes the second radio module 32 to the studs 48. Then, the user connects the first cable 34 to the output terminal 39 of the second radio module 32, and further connects the second cable 35 to the input terminal 38 of the second radio module 32. In this manner, the operation for mounting the second radio module 32 in place is completed, and the portable computer 61 can perform wireless communications in both the Bluetooth and UWB modes.

The electronic device according to the second embodiment has been described. According to the second embodiment, the connection mechanism 49 is mounted on the second printed circuit board 63. With this structure, the connection mechanism 49 can be provided without adversely affecting the arrangement of the circuit components 25 mounted on the first printed circuit board 17. For this reason, the second embodiment is especially advantageous to the case where the circuit components 25 are already arranged on the first printed circuit board 17 and where the first printed circuit board 17 has no room for the connection mechanism 49. Moreover, since the connection mechanism 49 is provided on the second printed circuit board 63 which is independent of the first printed circuit board 17, the connection mechanism 49 can be protected from the electromagnetic noise the first printed circuit board 17 may generate. The second embodiment is also advantageous to the case where the second printed circuit board 63 is prepared as a board which is independent of the first printed circuit board 17 and which has a different shape from that of the first printed circuit board 17. Where portable computers are of a type wherein the second radio module 32 is incorporated on the BTO basis, it is advantageous to provide the connection mechanism 49 on the second printed circuit board 63. If provided on the first printed circuit board 17, the connection mechanism 49 may be meaningless.

In the second embodiment, the first radio module 31 is a Bluetooth module, and the second radio module 32 is a UWB module. By use of these, the portable computer 61 can perform both wireless communications based on the Bluetooth standard and wireless communications based on the UWS standard.

The electronic devices of the present invention are not limited to portable computers, and may be applicable to portable information terminals and other types of electronic devices. In addition, the portable devices of the present invention may be modified in various ways without departing from the spirit and scope of the present invention.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic device comprising:

an antenna;

a first radio module configured to perform wireless communications by use of the antenna;

a second radio module configured to perform wireless communications by use of the antenna;

a first printed circuit board with reference to which the second radio module is attachable or detachable;

a first cable which connects the antenna and the second radio module together;

a second cable which connects the second radio module and the first radio module together; and a connection mechanism which connects the first and second cables together in a state where the second radio module is detached from the first printed circuit board.

2. The electronic device according to claim 1, wherein the connection mechanism is located on the first printed circuit board.

3. The electronic device according to claim 2, wherein the first printed circuit board includes an attachment area on which the second radio module is mounted.

4. The electronic device according to claim 2, wherein the connection mechanism includes a pair of relay connectors and a wiring line that connects the relay connectors together.

5. The electronic device according to claim 1, further comprising:

a second printed circuit board which is attached to the first printed circuit board in place of the second radio module, the connection mechanism being located on the second printed circuit board.

6. The electronic device according to claim 5, wherein the connection mechanism includes a pair of relay connectors and a wiring line that connects the relay connectors together.

* * * * *